United States Patent [19]

Karolyi

[11] Patent Number: 4,961,565

[45] Date of Patent: Oct. 9, 1990

[54] METHODS AND APPARATUS FOR FOLDING TEXTILE MATERIALS

[75] Inventor: Oskar Karolyi, Bad Boll, Fed. Rep. of Germany

[73] Assignee: Michael Hörauf Maschinenfabrik GmbH & Co. KG, Donzdorf, Fed. Rep. of Germany

[21] Appl. No.: 241,237

[22] Filed: Sep. 7, 1988

[30] Foreign Application Priority Data

Oct. 7, 1987 [DE] Fed. Rep. of Germany ..... 3733816

[51] Int. Cl.[5] ..... B42C 1/00

[52] U.S. Cl. ..... 270/45; 270/32; 493/405; 493/423; 493/937

[58] Field of Search ..... 270/30, 31, 32, 45, 270/51; 223/37, 38; 493/405, 422, 423, 441, 937

[56] References Cited

U.S. PATENT DOCUMENTS

| | | | |
|---|---|---|---|
| 3,768,800 | 10/1973 | Gutknecht | 270/30 |
| 3,918,699 | 11/1975 | Arbter | 493/405 |
| 4,106,260 | 8/1978 | King | 223/37 |
| 4,678,173 | 7/1987 | Basinger | 270/45 |
| 4,805,374 | 2/1989 | Yawberg | 270/32 |

FOREIGN PATENT DOCUMENTS

| | | | |
|---|---|---|---|
| 2424354 | 12/1979 | France | 223/37 |
| 61-75772 | 4/1986 | Japan | 270/31 |

*Primary Examiner*—Carl D. Price
*Assistant Examiner*—Therese M. Newholm
*Attorney, Agent, or Firm*—Burns, Doane, Swecker & Mathis

[57] ABSTRACT

Textile material is transferred by an upstream conveyor to a downstream belt conveyor such that a front end of the material rests on the downstream conveyor and a rear end thereof rests on the upstream conveyor. The upstream conveyor is displaced relative to the downstream conveyor such that the upstream conveyor passes over the downstream conveyor in a manner causing the material to be folded about a transverse fold line and deposited onto the downstream conveyor. The downstream conveyor is actuated to transfer the folded textile material to a folding mechanism.

21 Claims, 2 Drawing Sheets

METHODS AND APPARATUS FOR FOLDING TEXTILE MATERIALS

BACKGROUND OF THE INVENTION

The invention concerns an apparatus for the folding of textile material of the type in which a folding mechanism is preceded by two conveyors.

An apparatus of this type has been built by the assignee of the present invention. The folding machine is arranged to function so that the folded material will have approximately constant or equal dimensions.

It is an object of the invention to provide a folding apparatus of this type which would be applicable equally to the folding of textile materials into unequal dimensions, preferably so that the length in the direction of transport is larger.

SUMMARY OF THE INVENTION

The object is attained by the present invention which involves methods and apparatus for folding textile material. The apparatus comprises a folding mechanism, a first conveyor, and a second conveyor arranged to receive textile material from the first conveyor and transfer that material to the folding mechanism. The first and second conveyors are relatively displaceable so as to be repositioned relative to one another in a manner folding the textile material prior to the textile material being transferred to the folding mechanism.

The first of the two conveyors acts, together with the second conveyor, as a prefolding device. Even during the movement of the material to be folded to the folding mechanism, it may be shortened and reduced to the dimensions required. This is advantageous particularly in the folding of T-shirts.

THE DRAWINGS

The objects and advantages of the invention will become apparent from the following detailed description of a preferred embodiment thereof in connection with the accompanying drawings, in which like numerals designate like elements, and in which.

DETAILED DESCRIPTION OF A PREFERRED EMBODIMENT OF THE INVENTION

Figure 1:
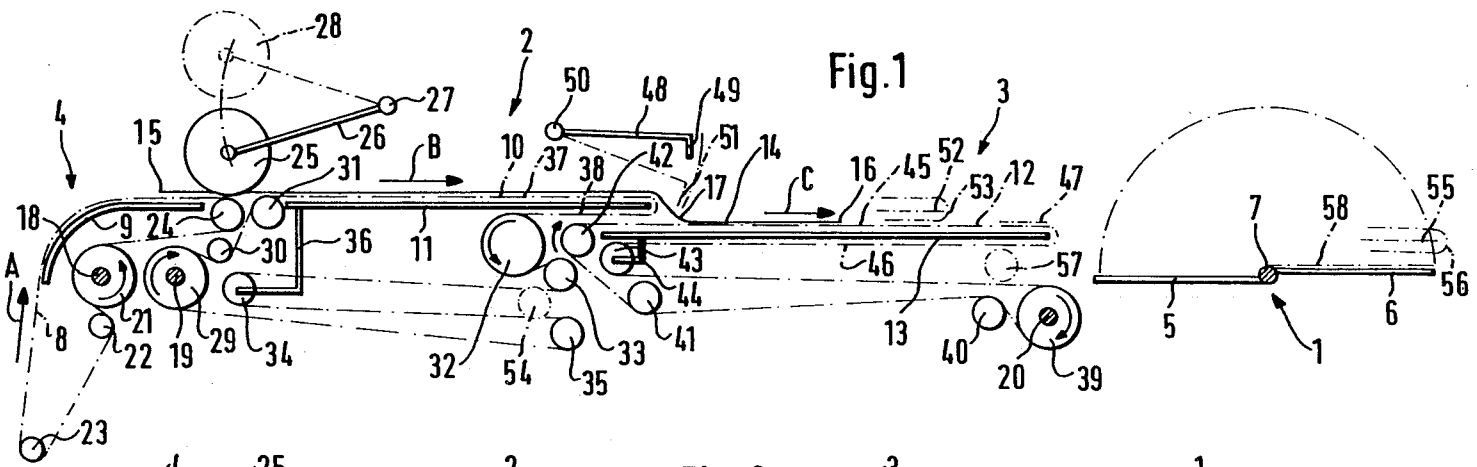
FIG. 1 is a side elevational view of an apparatus according to the invention.
Figure 2:
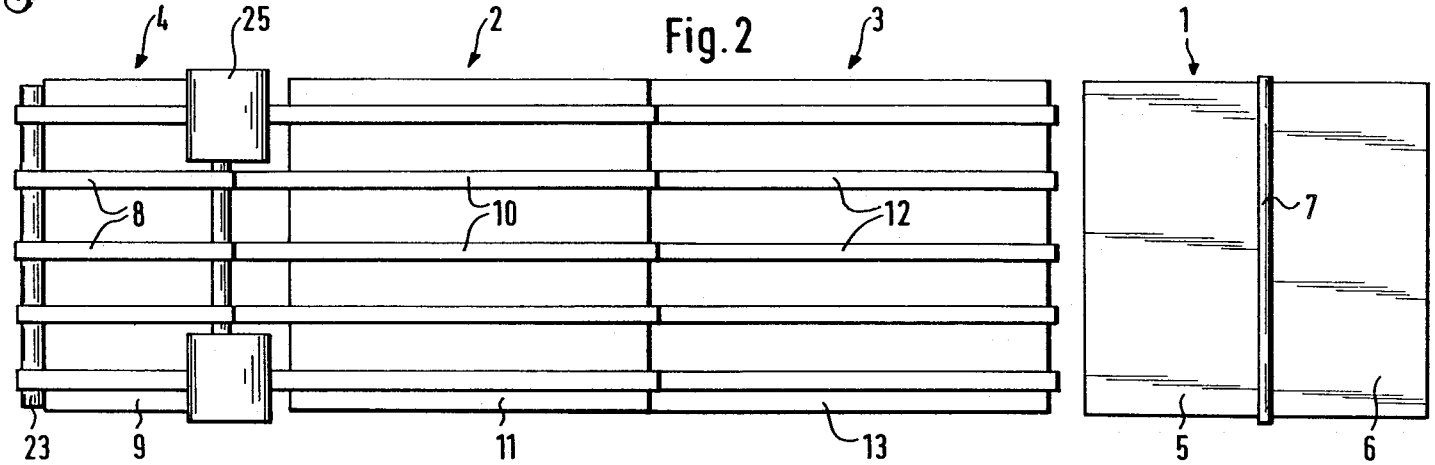
FIG. 2 is a top view of FIG. 1, with certain parts omitted for the sake of simplicity.

The apparatus according to FIGS. 1 and 2 comprises a folding device 1, which is preceded by a first conveyor device 2 and a second conveyor device 3 for handling textile material 14. The first conveyor device 2 is, in turn, preceded by a feeder device 4. The first conveyor device 2 and the feeder device 4 together constitute an upstream conveyor mechanism disposed upstream of the second conveyor mechanism 3.

The folding device 1 may have different configurations and may contain means for both the longitudinal and the transverse folding of the textile material 14. In FIGS. 1 and 2, two transverse folding devices 5 and 6 are shown, each of which is pivotable around an axle 7 oriented transverse to the direction of transport 3. During the transfer of the textile material in a direction of conveyance from the conveyor 2 to the folding device 1, the folders 5 and 6 are open (as shown in FIGS. 1 and 2).

In the disclosed preferred embodiment five feeder belts 8 are associated with the feeder device 4, the feeder belts being endless and capable of revolving in the direction of the arrow A when driven. A control means (not shown) determines when the belts are to be driven. In the area of the inlet end of the conveyor device 2, a feeder table 9 is provided upon which the feeder belts 8 are resting. The feeder table 9 is of a width greater than the width of the textile material 14. The feeder table 9 includes vertical and horizontal portions interconnected by a curved transition portion. The horizontal portion is aligned with the first conveyor device 2.

The first conveyor device 2 contains five first conveyor belts 10 which are endless and are capable of revolution in the direction of the arrow B, and are controlled by the afore-mentioned control means. Upper flights 37 of the first conveyor belts 10 are resting on a prefolding table 11, the outlet end of which forms a reversing guide around which the first conveyor belts 10 reverse their direction.

The second conveyor device 3 contains five second conveyor belts 12 capable of revolving in the direction of the arrow C, under the control of the control means. Upper flights 45 of the second conveyor belts 12 are resting on a so-called application table 13, the outlet end of which forms a reversing guide for the second conveyor belts 12.

The feeder belts 8, the first conveyor belts 10, and the second conveyor belts 12 may be driven for the transport of the textile material 14 synchronously in their respective directions of motion A, B, C. The drive is terminated when the textile material 14 has attained a predetermined position on the second conveyor device 3. In FIG. 1 an intermediate position is shown, in which the rear end 15 of the textile material 14 is still located in the area of the feeder table 9 and the front end 16 of the textile material has already reached the second conveyor device 3. At a transition zone 17 between the first and second conveyor devices 2, 3, the textile material 14 is relocated from a first plane into a second plane, the latter lying closely adjacent to and below said first plane.

It is not necessary that the first and second conveyor devices 2, 3 be running synchronously from the beginning. For example, it is necessary to drive the second conveyor device 3 in the direction of the arrow C only when the front end 16 of the textile material 14 has reached the outlet end of the first conveyor device 2. This yields the advantage that the conveyor devices 2 and 3, in the meantime, may perform other functions to shorten cycling times as will become apparent.

The feeder belts 8 are driven by means of a drive shaft 18, the direction of rotation of which is indicated by an arrow. The first belts 10 are driven by a second drive shaft 19, rotating in the direction of the depicted arrow. Finally, the second conveyor belts 12 are driven by a third drive shaft 20, rotating in the direction of the indicated arrow. The respective drives are actuated in cycles wherein the drives are actuated intermittently for transporting the textile material 14 to a predetermined position.

Fixedly mounted on the drive shaft 18 associated with the feeder belts 8 are five drive pulleys 21. Immediately downstream of the drive pulleys 21, deflection pulleys 22 are provided to tension the feeder belts 8. Further deflection pulleys 23 and 24 are located below the feeder table 9 and downstream of the outlet end of the feeder table 9, respectively.

Following the manual placement of the textile material 14 onto the feeder table 9 and the feeder belts 8 running on it, the textile material 14 is transported only when contact rolls 25 are displaced toward the deflection rolls 24. In the embodiment shown only two contact rolls 25 are provided which are located on the sides of the feeder table 9. It would be possible to provide a contact roll 25 for each of the feeder belts 8. The contact rolls 25 are mounted on levers 26 in a freely rotating manner. The levers 26 are capable of being pivoted into a raised position 28 around an axle 27 disposed transversely to the direction of transport or conveyance. Both the pivoting and application of the contact roll is effected cyclically. It may be provided that the contact rolls 25 pivot down only if the textile material is present on the feeder table 9. Suitable transducers may be provided for controlling this action.

Five drive pulleys 29 are mounted on the drive shaft 19 of the first conveyor belts 10, and are associated respectively with the first conveyor belts 10. By means of appropriate conventional clutches between the drive shaft 19 and the drive pulleys 29, the drive pulleys are only positively driven when the drive shaft 19 is motor-driven. If the drive shaft 19 is at rest, the drive pulleys 29 are able to rotate freely in both directions on the drive shaft 19.

Deflection rolls 30 are mounted immediately downstream of the drive pulleys 29. Further deflecting rolls 31 are located upstream of the inlet end of the prefolding table 11. In the direction of transport B, following the reversing guide associated with the outlet end of the prefolding table 11, a large-diameter idler roll 32 is rotatable in the transport direction B only. Immediately thereafter, additional deflecting rolls 33–35 are provided. The first conveyor belts 10 return from the deflecting rolls 33 to the vicinity of the drive pulleys 29, where the deflecting rolls 34 are provided. Disposed in the vicinity of the rolls 33, essentially vertically below them are deflecting rolls 35, from which the second conveyor belts 10 return to the drive pulleys 29. The clearance between the deflecting rolls 33 and 35 corresponds to the diameter of the deflecting rolls 34.

The deflecting rolls 34 are coupled with the prefolding table 11 by means of coupling devices 36 (shown schematically), so that they move together with the prefolding table 11 in a translatory manner.

On the drive shaft 20 for the second conveyor belts 12, a plurality of motor driven drive pulleys 39 is provided. Due to the provision of suitable clutches, when the drive shaft 20 is at rest, the drive pulleys 39 are freely rotatable in both directions and are motor driven only when the shaft 20 rotates in the direction of the arrow. Deflecting rolls 40 are disposed immediately downstream of the drive pulleys 39. Idler rolls 42 are located upstream of the inlet end of the applicable table 13 and beneath the prefolding table 11. Between the deflecting rolls 40 and the idler rolls 42, the second conveyor belts 12 are deflected slightly in direction by the deflecting rolls 41.

The idler rolls 42 associated with the inlet end of the application table 13 are able to rotate in the transport direction C only, and are blocked in the opposite direction of rotation by suitable conventional clutches, the significance of which is described below.

Immediately adjacent to the idler rolls 42, deflecting rolls 43 are provided. The second conveyor belts pass around the deflecting rolls 43 after reversing around the outlet end of the application table 13 and before passing around the drive pulleys 39. The deflecting rolls 43 are connected to the application table 13 by means of schematically indicated coupling elements 44.

As a result, the deflecting rolls 43 are capable of moving in a translatory fashion together with the application table, in a manner to be described below.

As described above, the upper flights 45 of the second conveyor belts 12 are resting on the application table 13. The application table 13 also guides the lower flights 46 of the conveyor belts 12..The vertical distance of the lower flights 46 from the drive pulleys 39 approximately corresponds to the diameter of the deflecting rolls 43.

To move the textile material 14 to the folding apparatus 1, the drives of the shafts 18, 19 and 20 are actuated only until the end 16 of the textile material 14 attains a terminal position 47 on the second conveyor device 3, indicated by the dotted line in FIG. 1. This terminal position 47 is situated in the area of the reversing guide defined by the outlet end of the application table 13. In this position, the textile material bridges the first and second conveyors 2, 3.

The location of the outlet end of the prefolding table 11 may be adjusted, depending on the desired extent of the prefolding. In the area of the outlet side of the prefolding table 11, a so-called folding knife 49 is located. The folding knife is mounted on a lever 48 which pivots around a stationary axle 50. The folding knife 49 may be moved, if necessary, into a position 51 wherein it comes into contact with the textile materials 14 at the aforedescribed transition location 17. This causes a folding line to be formed or kinked into the textile material, whereafter the folding knife 49 is raised into a retracted position shown in FIG. 1.

To prefold the textile material 14 (in a manner to be described later), the prefolding table 11 may be moved in a translatory fashion over the application table 13, until the outlet end of the prefolding table occupies a position 52 over the application table 13. The front ends of the conveyor belts 10 then lie at a position 53. In the course of this translatory movement of the prefolding table 11, the exact function of which is to be explained later, the deflecting rolls 34 coupled with the prefolding table 11 are moved into the position 54, where they are adjacent to the deflecting rolls 33 and 35.

The application table 13 may be moved for the transfer of the textile material 14 in a translatory motion toward the folding apparatus 1, until its outlet end occupies a terminal position 55 located slightly above the outer end of the folder 6. The front ends of the second conveyor belts 12 then lie at a position 56, and the deflecting rolls 43, coupled with the application table 13, are disposed at a position 57.

The operation of the prefolding of the textile material 14 will now be described with reference to FIG. 3.

Figure 3:
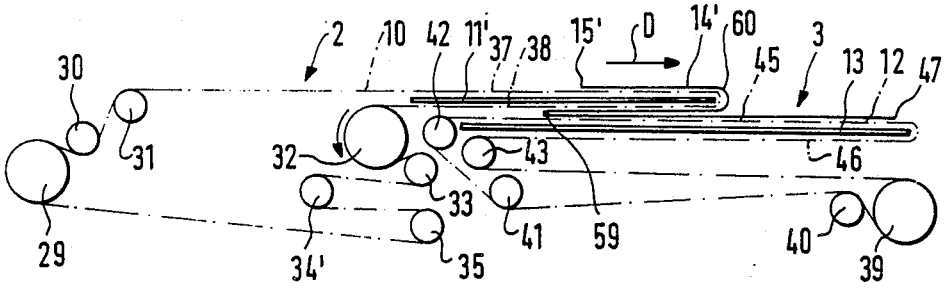
FIG. 3 is a partial view of FIG. 1 during the prefolding of the textile material.

The first conveyor device 2 functioning as a prefolding means together with the second conveyor device 3, are seen in FIG. 3. The remaining parts of the apparatus described in FIG. 1 are not shown in FIG. 3. The individual deflecting rolls are not described again. The textile material is disposed such that the front end thereof is in the terminal position 47 (see FIG. 1).

For prefolding, the prefolding table 11 is moved in translation in the direction of the arrow D, i.e., in the direction of conveyance, and repositioned forwardly over the application table 13. In FIG. 3 an intermediate position 11' of the prefolding table 11 is shown. The prefolding table is then moved further in the direction of the arrow D, until it attains its terminal position 52 indicated in FIG. 1.

During the movement of the folding table 11 in the direction D, the drive of the drive pulleys 29 is inactive, whereby the pulleys 29 are freely rotatable. The non-driven first conveyor belts 10 are thus entrained by the prefolding table 11, the idler roll 32, the pulleys 29, and the three rotating deflecting rolls 33, 34, 35.

It is important in prefolding that the idler roll 32 is blocked in one direction of rotation as previously indicated. The roll 32 is capable of revolving only in the direction corresponding to the normal drive of the first conveyor belts 10 for the normal transport of the textile material 14.

When the prefolding table 11 is being moved in the direction of the arrow D, the upper flights 37 of the first conveyor belts 10 must also move in the arrow direction D, at a velocity that is twice that of the prefolding table 11. As the locking rolls 32 are capable of rotating in the conveying direction only, the lower flight 38 of each of the first conveyor belts 10 does not move and the entire motion of each of the first conveyor belts 10 is carried out by the upper flight 37. As the deflecting roll 34 is coupled with the prefolding table 11, it travels to an intermediate position 34' depicted in FIG. 3. This movement is necessary so that the loop of the first conveyor belts 10 created in the area of the reversing guide on the outlet end of the prefolding table 11 is equalized, i.e., the loop located between the deflecting rolls 33 and 35 on the one hand, and the deflecting rolls 34' on the other, is correspondingly reduced.

Since the lower flights 38 are not moving relative to the machine, i.e., are stationary, the textile material 14' is forced to fold over, as shown in FIG. 3. The folding line 59 is at the transition location 17 indicated in FIG. 1, to which the folding knife 49 had been briefly applied. During the translatory motion of the prefolding table 11, the instantaneous deflecting edge 60 of the textile material 14' migrates progressively to the right, until the original rear end 15' of the textile material 14' finally travels off the first conveyor belts 10 and comes to rest on the lower portion of the material at a location adjacent the front end thereof. This completes the prefolding process and the prefolding table 11 may be returned into its initial position shown in FIG. 1, whereby the deflecting rolls 34' are also returned into their initial position. The prefolded textile material 14 remains unaffected on the second conveyor device 3.

The manner in which the prefolded textile material 14, which is now resting on the second conveyor device 3, is moved over the folding apparatus 1, is described in the following with reference to FIG. 4.

Figure 4:
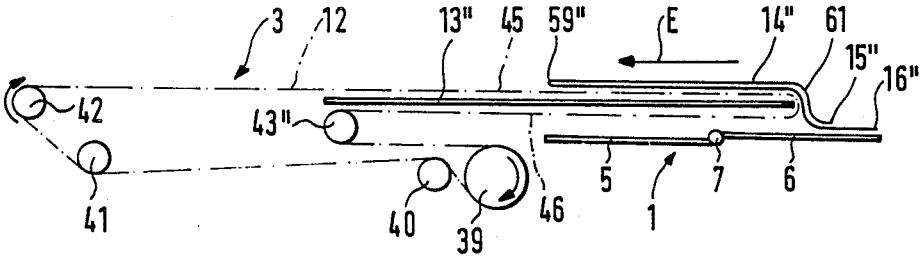
FIG. 4 is a further partial view of FIG. 1 during the transfer of the prefolded material to the folding mechanism.

Initially the application table 13 is moved forwardly, i.e., to the right opposite the direction of the arrow E in FIG. 4, until its reversing guide defined by the outlet end has occupied position 55 (shown in FIG. 1) over the folder 6. During that displacement stroke, the reflecting roll 43 is moved along with the application table by virtue of its coupling with the application table 13 to equalize the thread loop. Due to the movement of the deflecting roll 43, and the one-way rotation of the idler rolls 42, the upper flights 45 of the second conveyor belts 12 remain instantaneously immobile relative to the application table 13, so that the textile material 14 is also entrained in an area located above the folder 6. When the application table 13 has attained its terminal position 55 (shown in FIG. 1), it begins the deposition of the textile material 14 on the folding apparatus 1 in the below-described manner.

To effect such depositing, the folding table 13 is moved in a translatory manner in the direction of the arrow E (FIG. 4). In FIG. 4, an intermediate position 13" of the folding table 13 and an intermediate position 43" of the deflecting rolls 43 coupled with it are shown. Since the idler rolls 42 may rotate in the transport direction C only, as noted above, the upper flights 45 of the second conveyor belts 12 cannot follow the movement in the direction of the arrow E during the movement of the application table 13. Rather, the upper flights 45 are forced to travel around the outlet end of the application table 13". The lower flights 46, on the other hand, move in the direction of the arrow E, at twice the velocity of the application table 13". The textile material 14" is thereby forced to settle on the folding apparatus 1 in the manner shown in FIG. 4, where 61 indicates a transfer edge of the textile material leaving the application table. The instantaneous position 59" of the prefold line 59 and the instantaneous position 15" of the original rear end of the material are depicted. The positions of the ends 15" and 16" of the textile material 14" do not change during the deposition on the folding apparatus 1.

If desired, the operation of the drive shafts 18, 19, 20 (FIG. 1) may be effected so that the feeder belts 8 and the first conveyor belts 10 are already moving in the transport direction A and B, while the application table 13 is still carrying out its return motion in the direction of the arrow E, according to FIG. 4. It is merely necessary that the application table 13 occupy its position shown in FIG. 1 prior to the time at which the front end of the next piece of textile material reaches the outlet end of the first conveyor device 2, because at that instant the drive shaft 20 of the second conveyor device 3 must be actuated.

As the prefolding operation requires only the relative motion between the prefolding table 11 and the application table 13, it is also possible to superpose the normal transport movements on the translatory movements of the prefolding table 11 and the application table 13.

The textile material 14 prefolded in the above-described manner arrives by means of the second conveyor device 3 at the folding apparatus 1, where it is resting on the folder 5 and 6 of the folding apparatus 1. If now the folder 5 is rotated around the axle 7, in keeping with the semi-circle shown, into the position 58, the textile material is provided with an additional transverse fold. It is then located between the folder 6 and the folder 5 in the position 58. The further folding process is immaterial for the present invention and is therefore not described.

It will be appreciated that the materials can be folded to any desired lengths and configurations by a desired orientation of the material relative to the first and second conveyors prior to the prefolding operation, i.e., by positioning more or less of the length of the textile material on the second conveyor. Similarly, by adjusting the length of the displacement stroke of the second conveyor, the folded material can be deposited onto the flap folder at different positions relative to the axis 7, thereby varying the final configuration and size of the folded material.

Although the present invention has been described in connection with a preferred embodiment thereof, it will be appreciated by those skilled in the art that additions, modifications, substitutions, and deletions not specifically described may be made without departing from the spirit and scope of the invention as defined in the appended claims.

What is claimed is:

1. An apparatus for folding pieces of textile material which have front and rear ends, said apparatus comprising:

a folder mechanism for folding each piece of textile material, first conveyor means disposed upstream of said folder mechanism and including a prefolding table and first conveyor belt means movable around said prefolding table for supporting each piece of textile material thereon, second conveyor means disposed downstream of and below said first conveyor means and upstream of said folder mechanism, said second conveyor means including an application table and second conveyor belt means movable around said application table and arranged for receiving each piece of textile material from said first conveyor belt means in a direction of conveyance, said second conveyor belt means being actuable to transfer said piece of textile material to said folder mechanism, belt drive means for moving said first and second conveyor belt means around said prefolding table and said application table, respectively, for transferring the front end of a piece of textile material onto said second conveyor belt means to a location adjacent a downstream end of said second conveyor belt means, while the rear end of the piece of textile material remains disposed upstream of said second conveyor belt means, whereby said piece of textile material bridges said first and second conveyor belt means, table drive means for effecting relative displacement between said prefolding table and said application table in said direction of conveyance to prefold the conveyor-bridging piece of textile material about a fold line located adjacent an upstream end of said second conveyor belt means sufficiently to reposition the rear end of said piece of textile material over said second conveyor belt means at a location adjacent the front end of the piece of textile material, whereby movement of said second conveyor belt means around said application table transfers the prefolded piece of textile material, including the front and rear ends thereof, to said folder mechanism.

2. Apparatus according to claim 1, wherein said first conveyor belt means comprises a plurality of first endless conveyor belts arranged to travel around said prefolding table such that upper flights of said first conveyor belts are supported on said prefolding table.

3. Apparatus according to claim 2, wherein said prefolding table includes an outlet end around which said first conveyor belts reverse direction of travel.

4. Apparatus according to claim 3 including holding means for holding lower flights of said first conveyor belts stationary during displacement of said prefolding table.

5. Apparatus according to claim 4, wherein said holding means comprises a one-way idler roll around which said first conveyor belts travel.

6. Apparatus according to claim 4, wherein said first conveyor means comprises deflecting roll means around which said first conveyor belts travel, said deflecting roll means being coupled to said prefolding table for displacement therewith to take-up slack in said first conveyor belts during displacement of said prefolding table.

7. Apparatus according to claim 2, wherein said second conveyor means comprises an application table around which a plurality of second endless conveyor belts travel.

8. Apparatus according to claim 7, wherein said application table is displaceable relative to and over said folder mechanism.

9. Apparatus according to claim 8, wherein said application table includes an outlet end which defines a reversing guide around which said second conveyor belts reverse direction.

10. Apparatus according to claim 9, wherein said second conveyor belts include upper flights supported on said application table and arranged to travel solely in said direction of conveyance.

11. Apparatus according to claim 10 including a one-way idler roll around which said second conveyor belts travel, said one-way idler roll located adjacent an inlet end of said application table, said one-way idler roll being rotatable solely in a direction permitting said upper flights of said second conveyor belts to travel in said direction of conveyance.

12. Apparatus according to claim 11, wherein said second conveyor means includes a deflecting roll around which said second conveyor belts travel, said deflecting roll mounted for displacement with said application table to take-up slack in said second conveyor belts during displacement of said application table.

13. Apparatus according to claim 7 including a feeder table disposed upstream of said prefolding table, and feeder belts mounted for travel around said feeder table for feeding textile material to said first conveyor means.

14. Apparatus according to claim 13 including movably mounted contact rolls arranged to press textile material against said feeder belts.

15. Apparatus according to claim 1 including a folding blade arranged to contact a portion of textile material disposed between said first and second conveyor means for forming therein a fold line along which a folding of said textile material is promoted in response to relative displacement between said first and second conveyor means.

16. Apparatus according to claim 1, including a feeder conveyor disposed upstream of said first conveyor means, said feeder conveyor being driven to transfer the front end of each piece of textile material onto said first conveyor means.

17. Apparatus according to claim 1, wherein said first conveyor means is driven to transfer the front end of each piece of textile material onto said second conveyor means.

18. A method of folding pieces of textile material having front and rear ends, comprising the steps of:

arranging a first conveyor means upstream of a second conveyor means, said first conveyor means comprising a prefolding table and first conveyor belt means movable around said prefolding table, said second conveyor means comprising an application table and second conveyor belt means movable around said application table.

actuating a belt drive means for driving said first and second conveyor belt means around said prefolding table and said application table, respectively, to advance a piece of textile material in a direction of conveyance such that a front end thereof lies on said second conveyor belt means at a location adjacent a downstream end of said second conveyor belt means, and a rear end of the piece of textile material remains disposed upstream of said second conveyor belt means, subsequent to said actuating step, activating a table drive means for imparting relative displacement between said prefolding table and said application table in said direction of conveyance, whereby said first conveyor belt means passes over said second conveyor belt means in a manner prefolding said piece of textile material about a fold line extending transversely of said direction of conveyance at a location adjacent an upstream end of said second conveyor belt means, and depositing said folded textile material onto said second conveyor belt means, and moving said second conveyor belt means around said application table to transfer said folded piece of textile material including the front and rear ends thereof to a folding mechanism disposed downstream of said second conveyor means.

19. An apparatus for folding textile material comprising:

a folder mechanism for folding textile material, a first conveyor means for conveying textile material, said first conveyor means comprising a prefolding table and a plurality of first endless conveyor belts arranged to travel relative thereto such that upper flights of said first conveyor belts are supported on said prefolding table, a second conveyor means arranged to receive textile material from said first conveyor means and transfer said material to said folder mechanism, said second conveyor means comprising an application table and a plurality of second endless conveyor belts arranged to travel around said application table, said first and second conveyor means being relatively displaceable so as to be repositioned relative to one another in a manner folding said textile material prior to said textile material being transferred to said folder mechanism, said application table being displaceable relative to and over said folder mechanism in a direction parallel to a direction of transport of said textile material.

20. An apparatus for folding textile material comprising:

a folder mechanism for folding textile material, a first conveyor means for conveying textile material, a second conveyor means arranged to receive textile material from said first conveyor means and transfer said material to said folder mechanism, said first and second conveyor means being relatively displaceable so as to be repositioned relative to one another in a manner folding said textile material prior to said textile material being transferred to said folder mechanism, and a folding blade arranged to contact a portion of textile material disposed between said first and second conveyor means for forming therein a fold line along which a folding of said textile material is promoted in response to relative displacement between said first and second conveyor means.

21. An apparatus for folding textile material comprising:

a folder mechanism for folding textile material, a first conveyor means for conveying textile material, said first conveyor means comprising a prefolding table and a plurality of first endless conveyor belts arranged to travel relative thereto such that upper flights of said first conveyor belts are supported on said prefolding table, a second conveyor means arranged to receive textile material from said first conveyor means and transfer said material to said folder mechanism, said second conveyor means comprising an application table and a plurality of second endless conveyor belts arranged to travel around said application table, said first and second conveyor means being relatively displaceable so as to be repositioned relative to one another in a manner folding said textile material prior to said textile material being transferred to said folder mechanism, and a feeder table disposed upstream of said prefolding table, and feeder belts mounted for travel around said feeder table for feeding textile material to said first conveyor means.

* * * * *